US006691613B1

(12) United States Patent
Francille

(10) Patent No.: US 6,691,613 B1
(45) Date of Patent: Feb. 17, 2004

(54) IMPRESSION CYLINDER COMPRISING INDEXING MEANS FOR MOUNTING A PRINTING SLEEVE ON THE SUPPORT CYLINDER

(75) Inventor: Jean Francille, Pons (FR)

(73) Assignee: Polyfibron Technologies S.A., Cernay (FR)

( * ) Notice: Subject to any disclaimer, the term of this patent is extended or adjusted under 35 U.S.C. 154(b) by 0 days.

(21) Appl. No.: 09/979,031

(22) PCT Filed: May 19, 2000

(86) PCT No.: PCT/FR00/01374

§ 371 (c)(1),
(2), (4) Date: Aug. 23, 2002

(87) PCT Pub. No.: WO00/71344

PCT Pub. Date: Nov. 30, 2000

(30) Foreign Application Priority Data

May 20, 1999 (FR) ..... 99 06413

(51) Int. Cl.[7] ..... B41F 13/10

(52) U.S. Cl. ..... 101/375; 101/216; 101/481; 101/486

(58) Field of Search ..... 101/216, 375, 101/376, 389.1, 479, 481, 485, 486; 492/30, 47

(56) References Cited

U.S. PATENT DOCUMENTS

| | | | | |
|---|---|---|---|---|
| 3,858,287 A | | 1/1975 | Christofferson | |
| 5,062,193 A | | 11/1991 | Thompson | |
| 5,215,013 A | | 6/1993 | Vrotacoe et al. | |
| 5,513,568 A | | 5/1996 | Hoffman et al. | |
| 5,515,781 A | | 5/1996 | Songer | |
| 5,819,657 A | * | 10/1998 | Rossini | 101/376 |
| 2002/0046668 A1 | * | 4/2002 | Bell et al. | 101/376 |

FOREIGN PATENT DOCUMENTS

EP 0 510 744 10/1992

* cited by examiner

*Primary Examiner*—Andrew H. Hirshfeld
*Assistant Examiner*—Kevin D. Williams
(74) *Attorney, Agent, or Firm*—Leydig, Voit & Mayer, Ltd.

(57) ABSTRACT

The invention relates to a printing cylinder that includes a support cylinder, at least one printing sleeve for mounting the support cylinder, and a recess provided on a lateral face of the sleeve and emerging from an interior wall, and at least one indexing device borne by the support cylinder and that can project from it, the recess and each indexing device cooperating in order to mount the sleeve on the support cylinder while registering its position. According to the invention, the printing sleeve has at least one ring in an extension of an interior wall and which projects from the lateral face. The ring protects the sleeve from impacts between it and the indexing device during mounting of the sleeve on the support cylinder.

18 Claims, 3 Drawing Sheets

IMPRESSION CYLINDER COMPRISING INDEXING MEANS FOR MOUNTING A PRINTING SLEEVE ON THE SUPPORT CYLINDER

FIELD OF THE INVENTION

The invention relates to a cylindrical printing device including an assembly of a support cylinder, at least one printing sleeve intended to be mounted on the support cylinder, and indexing means for mounting each sleeve on the support cylinder. This cylindrical printing device is referred to here as a "printing cylinder".

BACKGROUND

It is known that in order to reduce waste in starting a printing machine, as well as an adjustment time for setting registration of colors, manufacturers of printing sleeves and builders of printing machines propose a system of registration of the printing sleeve on the corresponding carrier cylinder of the printing machine, also commonly called indexing by experts in the field.

This indexing system comprises a recess in the thickness of the printing sleeve and a device that cooperates with the recess, such as a small cylindrical piece, which is attached to the carrier cylinder. This indexing piece generally projects a distance of a few millimeters.

For a sleeve of relatively small thickness, particularly less than 15 mm, the recess can extend through the entire thickness of the sleeve. Thus, this recess, made in a lateral end face of the sleeve, opens onto both the interior wall and the exterior wall of the sleeve.

When the sleeve is thicker, with a thickness greater than 15 mm, in particular, the recess is not generally made through the entire thickness of the sleeve. One rather produces a receptacle in a lateral face of the sleeve that opens onto its interior wall. A key is fit and set in this receptacle, the recess for positioning the indexing device being produced by machining in this key.

Generally, the recess produced in the sleeve for its positioning on the indexing device extends according to a longitudinal generating line plotted on the exterior wall of the printing sleeve, this generating line being used to position the printing plates correctly.

Mounting of a printing sleeve on a carrier cylinder is done by an operator. This operator has to make the indexing device provided on the carrier cylinder enter the recess in the printing sleeve, while this indexing device is necessarily positioned on the side opposite from the operator.

This mounting is difficult, even for sleeves with small web widths, when they must be placed on cylinders in the upper part of the printing machine which are therefore poorly accessible to the operator.

This operation is even more difficult for printing sleeves of relatively large width, particularly greater than 600 mm, above all if the sleeve is very thick. In effect, in this case, the support cylinder with the indexing device is no longer visible to the operator, because of the thickness and the length of the sleeve.

The operator must therefore proceed by trial and error in order to make the recess in the sleeve and the indexing device borne by the support cylinder coincide. Impacts then occur between the printing sleeve and the indexing device.

The printing sleeves are generally mounted on a carrier cylinder by means of pressurized air that is injected at one of the ends of the carrier cylinder and emerges through openings arranged angularly around the cylinder. This creates a cushion of air between the carrier cylinder and the printing sleeve, which causes a slight radial expansion of the sleeve and allows the sleeve to move along and around the support cylinder.

It is possible to refer to the document EP-510744 which describes a support cylinder on which at least one printing sleeve is intended to be mounted.

The support cylinder has as many indexing devices as the number of sleeves, these indexing devices being retractable and capable of projecting from the surface of the support cylinder. This sleeve has, on one of its edges, a hollow in order to cooperate with the corresponding indexing device and in order to mount the sleeve in the appropriate position. Furthermore, mounting of the sleeves is done using a supply of compressed air.

Depending on the structure of the printing sleeves, the air pressure used changes the radial expansion of the sleeve and, by creation of a cushion of air, promotes an often violent propulsion of the printing sleeve, which advances jerkily on the carrier cylinder. Thus, when the recess of the sleeve is not aligned with the indexing device provided on the support cylinder, the sleeve knocks against it, which causes rapid deterioration of the face of the printing sleeve that has the recess.

This deterioration makes the printing sleeve unusable after a few mounting operations. The printer must then true the deteriorated face in order to eliminate any trace of the repetitive impacts, such as indentations and raised parts.

It is also appropriate to note that between two uses, the sleeves are stored with one face resting on the floor. These sleeves are not always handled with care, which leads to impacts to and deformations of the face resting on the floor, all the more since the sleeves are heavy and the floor often contains uneven places and even waste.

Finally, mounting of each sleeve is done by trial and error, above all when the support cylinder intended to receive the sleeve is not very accessible, and the sleeve is very large and heavy.

SUMMARY OF THE INVENTION

This mounting therefore takes a relatively long time, which increases the loss of printing time that is sentimental to a printer.

The invention aims to offset these disadvantages and to facilitate the work of the operators by proposing a printing cylinder with a sleeve having a ring that protects the cylinder from possible impacts and that can also be used for guidance during mounting of the sleeve.

Thus, the invention relates to a printing cylinder that includes a support cylinder, at least one printing sleeve intended to be mounted on said support cylinder, and means of indexing each sleeve on the support cylinder, the indexing means including a recess or the like on a lateral face of the sleeve, and at least one indexing device borne by the support cylinder and that projects from it, the recess and each indexing device being intended to cooperate in order to mount the sleeve on the support cylinder while registering it. The printing sleeve has at least one ring in the extension of its interior wall and which at least in part projects from the lateral face, so that the ring, in which the recess or the like is present, protects the sleeve from impacts between it and the indexing device during mounting of the printing sleeve on the support cylinder.

In a first embodiment variant, the ring is produced in the form of a single piece together with the sleeve, in particular by machining.

In a second embodiment variant, the ring is a piece that is connected on or in the sleeve, particularly by adhesive bonding, by crimping, or by direct molding.

In this case, the ring is produced from an elastic and shock absorbing material, such as aluminum or a plastic material such as polyamide, PTFE (polytetrafluoroethylene), polycarbonate, PU (polyurethane), PES (polyether sulfone), or PE (polyethylene).

Preferably, the ring includes means of guiding the indexing device borne by the support cylinder towards the recess in the ring.

The guidance means advantageously includes two inclines, arranged on opposite sides of the recess, each of the inclines extending from the recess to the exterior edge of the ring.

Preferably, these inclines are symmetrical with respect to the recess.

particular, they can be helical or linear.

Each incline corresponds to an angle which is advantageously between 25 and 60°, and is preferably equal to 45°.

Preferable a stop is provided between the exterior, edge of the ring and the end of at least one incline, at an end opposite from the recess.

The printing sleeve of the cylinder according to the invention advantageously includes a ring with a recess on each of its lateral faces, so that it can be reversibly mounted.

In order to facilitate the work of the operators, the printing sleeve has, on a lateral face opposite the lateral face including the ring, and which is intended to be visible to an operator during mounting of the sleeve on the support cylinder, means of visualizing the corresponding location of the recess, and, possibly, the means of guidance, on the face of the sleeve that has the ring.

The printing sleeve of the printing cylinder according to the invention can have means of visualizing each of its lateral faces, for reversible mounting.

The printing sleeve advantageously has, on its exterior wall, integrated guides for installation and cutting using a cutting tool of a stereotype plate and/or double sided adhesive placed on the sleeve.

In one embodiment of the printing cylinder, the support cylinder has several indexing devices, which are at least in part retractable.

The indexing devices of the support cylinder can be arranged according to a generating line of the support cylinder.

Finally, an intermediate sleeve can be already arranged on the support cylinder before mounting of the printing sleeve. In this case, the indexing devices are positioned on the exterior surface of this intermediate sleeve.

BRIEF DESCRIPTION OF THE DRAWINGS FIGURES

The invention will be better understood, and other aims, advantages and characteristics of it will appear more clearly, upon reading of the following description, given with reference to the appended drawings that represent non-limiting embodiment examples of the invention, in which:

FIG. 1 partially represents a printing cylinder according to the invention and that has a printing sleeve in the process of being mounted on the support cylinder;

FIG. 2 partially represents a printing cylinder according to the invention and that has a printing sleeve mounted on the support cylinder;

DETAILED DESCRIPTION

Figure 1:
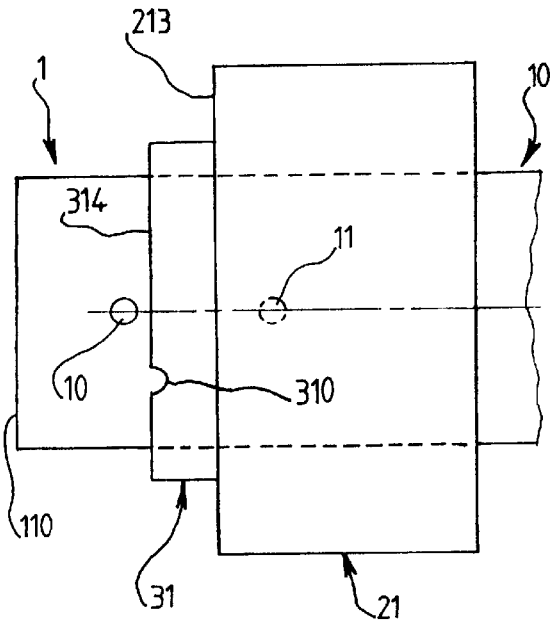

Reference is first of all made to FIG. 1, which illustrates a printing cylinder that includes support cylinder 1, which, in this case, is cylindrical in shape.

On this support cylinder 1, printing sleeve 21 is in the process of being mounted, with it being understood that the invention is not limited to this embodiment. A printing cylinder according to the invention could also include at least two printing sleeves.

Provided on support cylinder 1 are indexing devices 10, 11 that are aligned according to a longitudinal generating line of the support cylinder.

In practice, the support cylinder has at least one indexing device cooperating with the sleeve in order to position it appropriately on the support cylinder.

The presence of several indexing devices for a printing sleeve makes it possible to position the sleeve at different places on the support cylinder.

Several indexing devices are necessary when several printing sleeves are to be mounted on the support cylinder.

Each indexing device can in particular take the form of a small piece that extends radially, projecting with respect to the surface of support cylinder 1.

These small pieces may consist of cylindrical pieces made of steel. They can be mounted in a fixed manner on support cylinder 1, or else they can be retractable. In this regard, EP0 510744, which describes a retractable indexing device that consists of a cylindrical part that can slide radially in a recess provided in the support cylinder, elastic means being provided between the bottom of the recess and an end of the small cylindrical piece so that, in the normal position, the small piece is pushed by the elastic means toward the outside support cylinder surface. By contrast, when pressure is exerted on the small piece, particularly during the passage of a printing sleeve, the cylindrical piece is retracted toward the interior of the recess.

Figure 2:
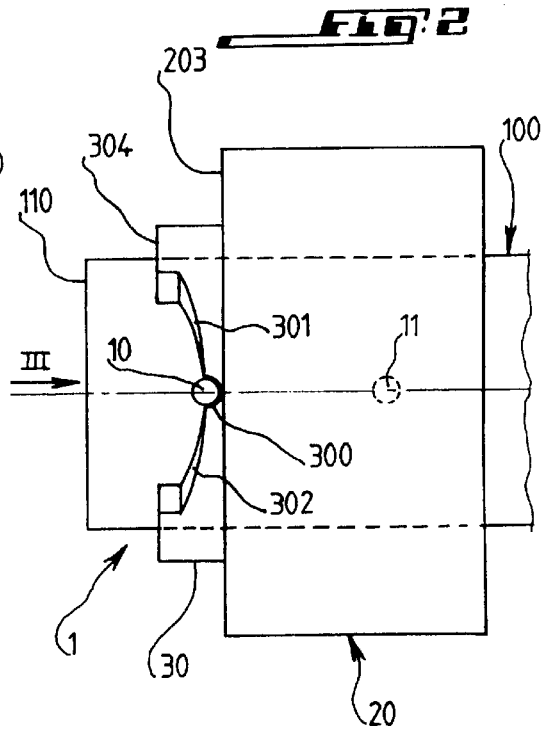

FIG. 2 shows printing sleeve 20 mounted on the support cylinder.

Figure 3:
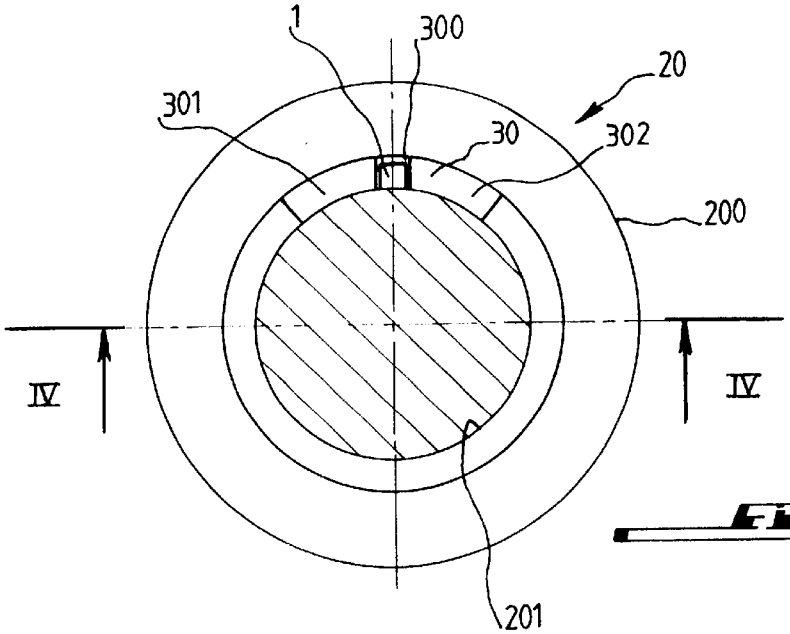
FIG. 3 is an end view corresponding to III of FIG. 2.

Sleeves 20, 21 are of roughly identical construction, and the description of the structure of these sleeves will be made only for sleeve 20, which is also illustrated in FIG. 3.

Sleeve 20 has external wall 200 and internal wall 201, both walls being roughly cylindrical. The diameter of internal wall 201 is adapted to the diameter of the support cylinder and to the technique of mounting on this support cylinder.

This mounting can in particular take place by means of a supply of compressed air that penetrates to the interior of the support cylinder, which is at least partially hollowed out, in order to exit through valves provided on the exterior surface of the support cylinder. The compressed air supply device, as well as these valves, are not illustrated in the FIGS. They are conventional means to the expert in the field, which are illustrated particularly in the document EP-0 510744. The diameter of internal wall 201 of sleeve 20 is then slightly smaller than the diameter of the support cylinder.

The diameter of exterior surface 200 of sleeve 20 corresponds to the desired development.

On one of its lateral faces 203, sleeve 20 has projecting ring 30.

Arranged in this ring 30 is recess 300 or the like, which is intended to cooperate with indexing device 10 provided on the support cylinder for sleeve 20.

In this example, the indexing device consists of a small cylindrical piece, and recess 300 therefore has a corresponding rounded shape.

Ring 30 is in the extension of interior wall 201 of sleeve 20, and the recess extends over the entire thickness of ring 30.

This ring 30 can be directly machined in sleeve 20, as illustrated by FIGS. 1 to 3. Other embodiments of this ring are described in reference to FIGS. 4 to 6.

Preferably means of guidance are associated with this recess 300, in order to facilitate insertion of indexing device 10 in recess 300 during mounting of sleeve 20.

The means of guidance can, in particular, include two inclined surfaces 301 and 302 arranged on opposite sides of recess 300 and that extend from the recess to exterior edge 304 of the ring. These guidance means will be described in more detail in reference to FIG. 4.

The mounting of a printing sleeve on the support cylinder will now be described in more detail, in reference to FIGS. 1 and 2.

Each sleeve 20, 21 is slipped over support cylinder 1 from its end 100 that is situated opposite from indexing devices 10 and 11. For this purpose, support cylinder 1 can be supplied with compressed air, which causes a slight radial expansion of each sleeve, which can easily slide on the support cylinder.

As indicated in the preceding, the operator generally proceeds by trial and error, and he does not necessarily position the sleeve in such a way that its recess is facing the corresponding indexing device.

This particularly is the case for sleeve 21, which also has recess 310 in a projecting ring 31 that is provided on its lateral face 213. It should be noted that ring 31 does not have any means of guidance associated with recess 310.

Thus, when sleeve 21 is advanced toward the other end 110 of support cylinder 1, exterior edge 314 of ring 31 will come in contact with indexing device 10.

As indicated in the preceding, impacts generally occur between the sleeve and the indexing device until the operator correctly positions the sleeve by rotating it around support cylinder 1.

With a printing sleeve according to the invention, these impacts are applied against the ring and not against the sleeve itself, which makes it possible to avoid any deterioration of the sleeve.

This is why it is necessary for the ring to project, at least in part, relative to the lateral face of the sleeve, so that it can effectively protect the sleeve from impacts that can occur between it and the indexing device during mounting of the sleeve on the carrier cylinder.

As for sleeve 20 illustrated in FIG. 2, it is already positioned on support cylinder 1, with indexing device 10 cooperating with recess 300 provided in ring 30.

The presence of guiding inclines 301, 302 facilitates the work of the operator, since they have made it possible to guide indexing device 10 into recess 300 when the operator has rotated sleeve 20 around the support cylinder.

As indicated in the preceding, the ring projecting from the lateral face of the printing sleeve according to the invention can be machined directly in the sleeve.

A sleeve that is well suited to this machining operation is described in the document EP0 683 040. This sleeve in particular has at least one layer of material with a high percentage of void volume and that has holes passing through it distributed over its surface, this layer being coated with a layer of resin.

After machining of the ring in the sleeve, it is also possible to provide for reinforcing this ring by any appropriate reinforcing material, and particularly by locally depositing a resin.

Figure 4:
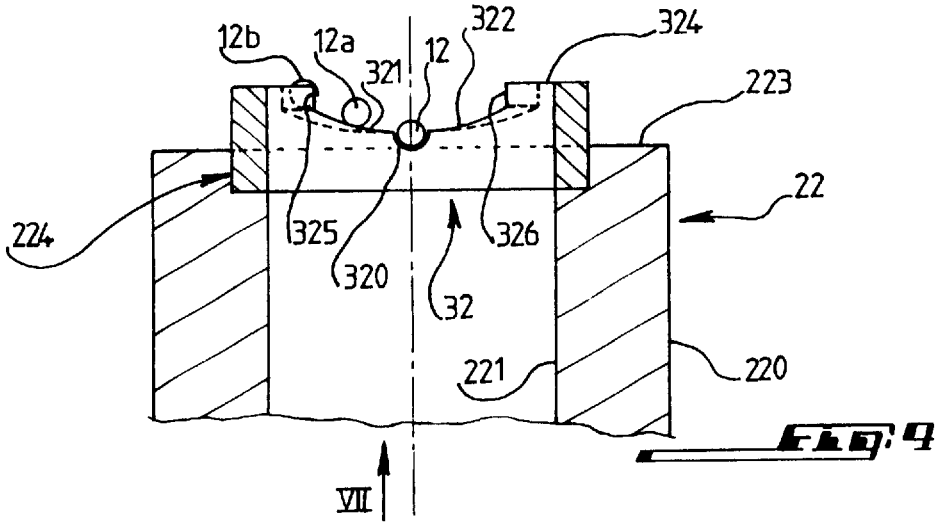
FIG. 4 is a view in cross section taken along line IV—IV of FIG. 3, and represents an embodiment of the ring.

Reference is now made to FIG. 4, which illustrates an embodiment variant of the ring described in reference to FIGS. 1 to 3.

FIG. 4 partially illustrates sleeve 22, which is also roughly cylindrical and which is intended to be mounted on support cylinder 1.

On lateral face 223 of sleeve 22, ring 32 is also provided, which is not machined in the sleeve but connected onto it.

This ring 32 can be produced independently and then attached in an appropriate recess 224 in interior surface 221 of sleeve 22. This recess 224 does not open onto exterior wall 220 of the sleeve, in order to be able to hold ring 32 that is mounted by any appropriate means, and particularly by adhesive bonding or shrinking.

Figure 5:
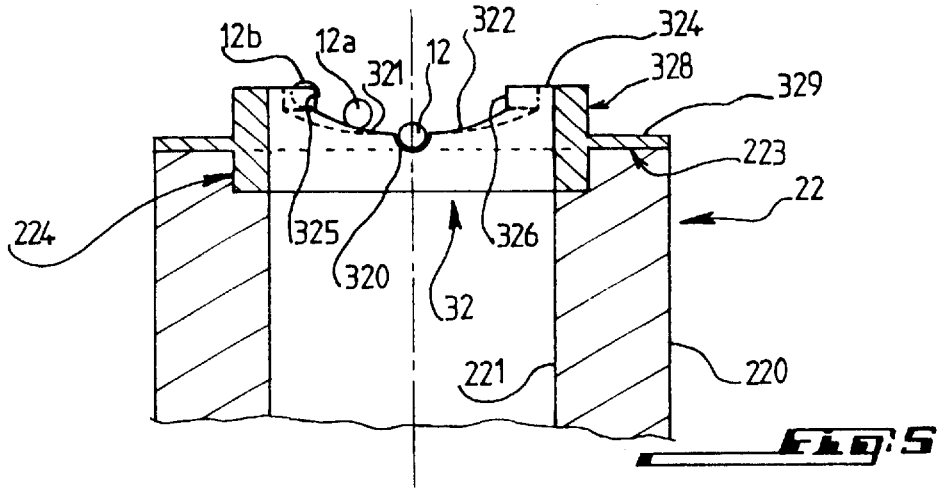
FIG. 5 is a view similar to FIG. 4 that represents another embodiment of the ring.

FIG. 5 illustrates an embodiment variant of ring 32, which has, projecting from exterior wall 328, annular part 329 that is intended to completely cover lateral face 223 of sleeve 22. This annular part 329 thus constitutes an edge for completely protecting the lateral face of the sleeve.

Figure 6:
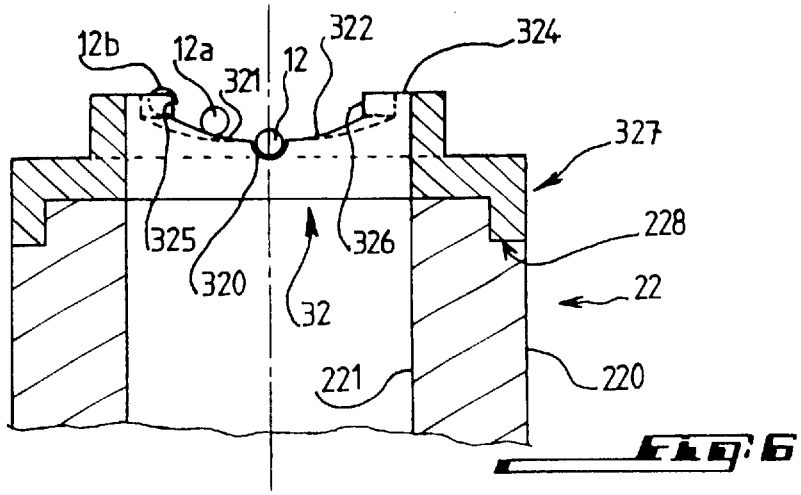
FIG. 6 is a view similar to FIG. 4 that represents yet another embodiment of the ring.

As illustrated by FIG. 6, ring 32 produced independently can be extended by roughly cylindrical part 327, having an exterior diameter corresponding to the exterior diameter of sleeve 22, and crimped into recess 228 produced in exterior wall 220 of the sleeve.

The ring could also simply be butt-joined to the sleeve at its end.

Ring 32 can also be produced directly in sleeve 22 by molding of resin in annular recess 224.

This ring can be produced from any elastic and shock absorbing material, such as aluminum or a plastic material such as polyamide, PTFE, polycarbonate, PU, PES, or PE.

This ring 32 partially projects with respect to lateral face 223 of sleeve 22, so that is effectively able to protect the sleeve itself from impacts with the indexing device during mounting of the sleeve on the support cylinder.

This part of the ring that projects preferably has a minimum height of one millimeter.

Produced on exterior edge 324 of the ring is recess 320, which is intended to receive indexing device 12 associated with sleeve 22 and attached to the support cylinder.

Preferably, the internal diameter of the ring is greater than the internal diameter of the printing sleeve. This facilitates the initial mounting of the sleeve on the support cylinder, which consists of force fitting with a back and forth movement, combined with an axial force, in order to lead the sleeve to cover the openings that open onto the external surface of the support cylinder and that are associated with a device for supply of compressed air, and in order thus to make possible the creation of a cushion of air for the complete mounting of the printing sleeve. This initial mounting is conventionally called "boxing".

As indicated in the preceding, ring 32 preferably has some means of guidance in order to facilitate the work of the operator. However, these guidance means are not necessary for the ring to fulfill its function of protecting sleeve 22 from possible impacts.

The guidance means represented includes two inclined surfaces 321 and 322, on surfaces with a curvature as shown in FIGS. 2 and 4–6, that extend from recess 320 to exterior edge 324 of ring 32.

These two inclines are advantageously symmetrical with respect to recess 320, but this is not limiting.

These inclines can be helical as illustrated in FIG. 4, or else linear.

Furthermore, each incline extends over a sector corresponding to an angle between 25 and 60° and preferably approximately 45°.

It can be observed that the sliding quality of the material constituting the ring and a relatively large angular opening of the two inclines considerably facilitate the work of the operator, above all with support cylinders that are difficult to access. Preferably, each incline 321, 322 is connected to exterior edge 324 of ring 32 by the intermnediary of a set-back 325, 326 forming a stop.

Thus, when an operator has placed sleeve 22 on the support cylinder, in such a way that the relative position of ring 32 and of indexing device 12 is illustrated by reference 12*a*, if the operator rotates the sleeve in the clockwise direction, the relative position of ring 32 and of the indexing device will become that which is illustrated by reference 12*b*.

The operator will then detect that the sleeve is stopped against the indexing device, and that it is appropriate to rotate it in the counter-clockwise direction.

In the case in which ring 32 is produced of a material with a low coefficient of friction, the act of pressing axially on the sleeve is sufficient to make it rotate until it reaches its locking position.

This rotational movement of the sleeve necessarily leads to the cooperation of recess 320 and indexing device 12, which becomes engaged in the recess.

Thus, the presence of two inclines with stops indicates to the operator which direction he must rotate the sleeve in order to reach the mounted and locked position of the sleeve.

The guiding inclines fulfill their function particularly well when the operator positions the sleeve beforehand on the support cylinder in such a way that the indexing device is facing one of the two guiding inclines.

Figure 7:
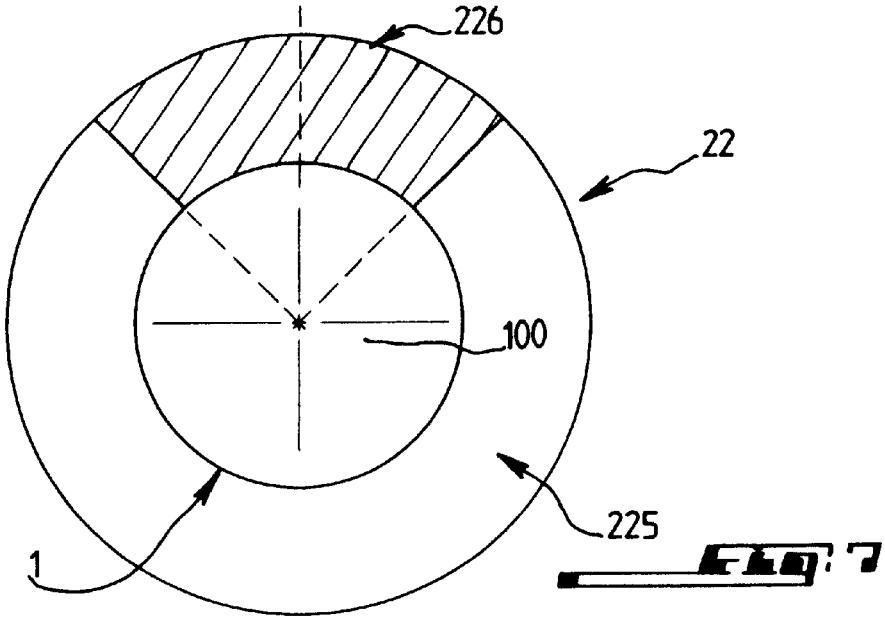
FIG. 7 is an end view corresponding to VII of FIG. 4.

This is why some means of visualization are advantageously provided on face 225 of sleeve 22, opposite from lateral face 23 from which ring 32 projects, as illustrated in FIG. 7.

It is this face 225 that is visible to an operator during mounting of sleeve 22.

These means of visualization 226 can take on different forms, in particular a band with a color distinct from that of the rest of lateral face 225 of the sleeve, a raised zone such as a set-back, a recessed zone, or an etched zone.

These means of visualization 226 extend according to a sector that is roughly identical to that of the means of guidance provided on ring 32, and are roughly centered on recess 320 of ring 32.

Thus when the operator positions sleeve 22 on support cylinder 1, these means of visualization allow him to preposition sleeve 22 with respect to indexing device 12, inasmuch as front surface 100 of carrier cylinder 1 also has means of marking of the position of the indexing device on the carrier cylinder. This means of marking can particularly take the form of a radial line on front surface 100 of carrier cylinder 1.

Figure 8:
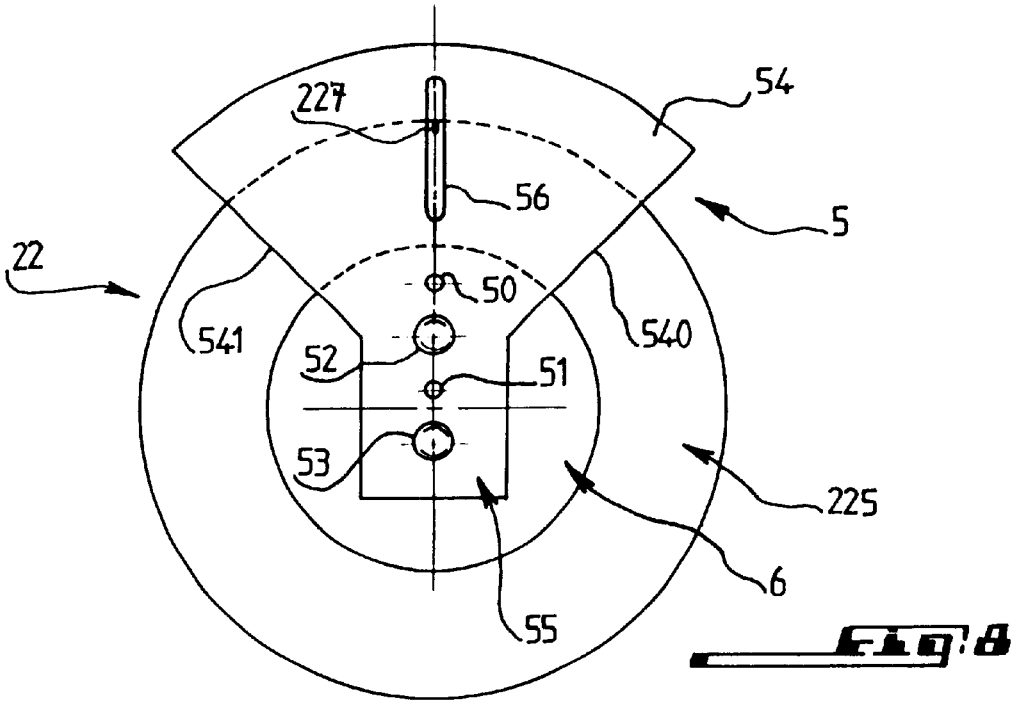
FIG. 8 is an endview of a template that can be fitted to a sleeve of the printing cylinder according to the invention.

FIG. 8 illustrates an example of a template for determining the position of means of visualization 226 on surface 225 of sleeve 22.

This template 5 is attached to centering ring 6 that is intended to be placed inside sleeve 22.

Template 5 is positioned on centering ring 6 by means of centering feet passing through openings 50 and 51.

Template 5 is furthermore attached to centering ring 6 with locking screws passing through openings 52 and 53 made in template 5.

This template 5 has the shape of disk portion 54 that is extended by foot 55. Disk portion 54 corresponds to an angle similar to that of the guidance means provided on ring 32.

Template 5 is positioned with respect to sleeve 22 in such a way that its central slot 56 exposes mark 227 made on sleeve 22 and corresponding to the location of the recess 320 of ring 32.

Exterior edges 540 and 541 of disk part 54 then make it possible to determine the zone of surface 225 of sleeve 22 in which means of visualization 226 will be provided.

Thus, the ring provided on a face of the printing sleeve according to the invention effectively makes it possible to protect it from impacts that can occur during mounting.

This ring also makes it possible to protect the sleeve from impacts to which it can be subjected during handling outside of a printing machine, and particularly during storage. In effect, inasmuch as the printing sleeve is disposed on the floor via the intermediary of a ring, the latter also fulfills a function of protection from impacts.

The ring also protects the sleeve during its initial mounting, or boxing, which leads it to cover the openings for passage of compressed air, which ensures the creation of a cushion of air for the complete mounting of the sleeve. In effect, the operation of boxing puts great stress on the end of the sleeve, which can be damaged.

Furthermore, a printing sleeve can have, on each of its lateral faces, a ring as previously described, with a recess which is intended to cooperate with an indexing device provided on the support cylinder. This embodiment makes possible reversible mounting of the printing sleeve on the support cylinder.

In this case, the means of visualization described in reference to FIG. 7 can also be provided on the two lateral faces of the sleeve, again in order to make reversible mounting possible.

It can also be noted that the presence of this ring in the printing sleeve makes it possible to eliminate the keys that are necessarily provided in a sleeve of relatively large thickness.

In the preceding description, the sleeves are mounted directly on the support cylinder. However, the invention is not limited to this application, and a sleeve according to the invention could also be mounted on another sleeve or an intermediate sleeve already in place on the support cylinder. In this case, the indexing devices are positioned on the exterior surface of this intermediate sleeve.

Finally, a printing sleeve used in the context of this invention can advantageously have, on its exterior surface, a cutting guide (not illustrated).

Such a guide is in particular described in the document WO 98/58803, and consists of a groove made in the sleeve and lined with a hard material. Each groove serves as a marker for mounting a plate and as guide for the cutting tool used to cut the double sided adhesive that extends out past the plate. Since this material is hard, the cutting tool cannot degrade the sleeve, and the guiding function of the groove prevents the tool from slipping on the plate.

Thus, these cutting guides make it possible to facilitate mounting of a plate on a sleeve, while preventing deterioration of the sleeve or of the plate.

Advantageously, a cutting guide extending according to a generating line of the sleeve faces the recess in the ring. In this case, the guide replaces mark 227 that was described in reference to FIG. 8.

Any printing sleeve intended to receive one or more raised printing plates can be used in the context of the present invention. The sleeve can also have, on its external surface, an endless printing form of the flexographic, typographic, heliographic, offset or digital type. It can have layers on its external surface made of elastomer, metal, or ceramic.

What is claimed is:

1. A printing cylinder that includes:

a support cylinder;

at least one printing sleeve for mounting on said support cylinder;

means for indexing each printing sleeve on the support cylinder, said indexing means including at least one indexing device borne by said support cylinder and projecting from said support cylinder, and at least one ring projecting from a lateral face of said printing sleeve for protecting said printing sleeve from impacts with the indexing device during mounting of the printing sleeve on said support cylinder, said at least one ring including a recess for cooperating with the at least one indexing device for mounting and registering said printing sleeve on said support cylinder.

2. The printing cylinder according to claim 1, wherein said ring is a single piece together with the sleeve.

3. The printing cylinder according to claim 1, wherein said ring is connected on or in said sleeve, by one of direct molding, adhesive bonding, and crimping.

4. The printing cylinder according to claim 3, wherein said ring is an elastic and shock absorbing material selected from the group consisting of aluminum and a plastic material including polyamide, PTFE (polytetrafluoroethylene), polycarbonate, PU (polyurethane), PES (polyether sulfone), or PE (polyethylene).

5. The printing cylinder according to claim 1, wherein said ring includes means for guiding said indexing device borne by said support cylinder towards the recess in said ring.

6. The printing cylinder according to claim 5, wherein said means for guidance includes two inclined surfaces on opposite sides of the recess, each of said inclined surfaces extending from the recess to an exterior edge of said ring.

7. The printing cylinder according to claim 6, wherein said inclined surfaces are symmetrical with respect to the recess.

8. The printing cylinder according to claim 6, wherein said inclined surfaces are helical.

9. The printing cylinder according to claim 6, wherein said inclined surfaces are linear.

10. The printing cylinder according to claim 6, wherein each inclined surface corresponds to an angle between 25 and 60°.

11. The printing cylinder according to claim 6, including a stop located between an exterior edge of said ring and an end of at least one inclined surface, opposite the recess.

12. The printing cylinder according to claim 1, wherein said printing sleeve includes a ring with a recess on each lateral face of said ring, for reversible mounting on said support cylinder.

13. The printing cylinder according to claim 1, wherein said printing sleeve has, on one of said lateral faces, opposite said lateral face including said ring, means for visualization of a corresponding location of the recess, and means for guidance on said lateral face of said sleeve that includes said ring to facilitate mounting of said sleeve on said support cylinder.

14. The printing cylinder according to claim 12, wherein said printing sleeve includes means for visualization on each of lateral faces, for reversible mounting.

15. The printing cylinder according to claim 1, wherein said printing sleeve has, on an exterior wall, at least one of integrated guides for installation and double sided adhesive on said sleeve.

16. The printing cylinder according to claim 1, wherein said support cylinder includes a plurality of retractable indexing devices.

17. The printing cylinder according to claim 16, wherein said indexing devices are arranged according to a generating line of said support cylinder.

18. The printing cylinder according to claim 1, including an intermediate sleeve located between said support cylinder and said printing sleeve, each indexing device being positioned on an exterior surface of said intermediate sleeve.

* * * * *